US010837650B2

(12) United States Patent
Hildner et al.

(10) Patent No.: US 10,837,650 B2
(45) Date of Patent: Nov. 17, 2020

(54) DOMESTIC APPLIANCE AND DOOR FOR A DOMESTIC APPLIANCE

(71) Applicant: ELECTROLUX APPLIANCES AKTIEBOLAG, Stockholm (SE)

(72) Inventors: Dietmar Hildner, Rothenberg ob der Tauber (DE); Peter Hoffmann, Rothenberg ob der Tauber (DE); Branko Ivanovic, Rothenberg ob der Tauber (DE); Erhard Käser, Rothenberg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 200 days.

(21) Appl. No.: 16/099,210

(22) PCT Filed: May 9, 2017

(86) PCT No.: PCT/EP2017/061091
§ 371 (c)(1),
(2) Date: Nov. 6, 2018

(87) PCT Pub. No.: WO2017/198502
PCT Pub. Date: Nov. 23, 2017

(65) Prior Publication Data

US 2019/0178503 A1 Jun. 13, 2019

(30) Foreign Application Priority Data

May 19, 2016 (EP) ..... 16170393

(51) Int. Cl.
*E05B 1/00* (2006.01)
*F24C 15/02* (2006.01)
*D06F 39/14* (2006.01)

(52) U.S. Cl.
CPC ..... *F24C 15/024* (2013.01); *D06F 39/14* (2013.01)

(58) Field of Classification Search
CPC ..... Y10T 16/44; Y10T 16/458; Y10T 16/513; F24C 15/024; F06F 39/14
See application file for complete search history.

(56) References Cited

U.S. PATENT DOCUMENTS 2,778,000 A * 1/1957 Mills ..... F25D 23/028 439/31
3,659,063 A * 4/1972 Peterson ..... H01H 3/162 200/61.7

(Continued)

FOREIGN PATENT DOCUMENTS

CN 1704679 A * 12/2005
DE 102010003898 A1 * 11/2011 ..... F24C 15/024

(Continued)

OTHER PUBLICATIONS

International Search Report & Written Opinion issued in corresponding application No. PCT/EP2017/061091 dated Jul. 13, 2017, 11 pages.

*Primary Examiner* — Chuck Y Mah
(74) *Attorney, Agent, or Firm* — Pearne & Gordon LLP

(57) ABSTRACT

The present invention relates to a door (10) for a domestic appliance, in particular an oven door (10) for a cooking oven. The door (10) comprises a front panel (12) and at least one door handle (14) made of metal and arranged at an outer side of said front panel (12). The door (10) comprises at least one electric and/or electronic device (18) arranged inside and/or at the door handle (14). The door (10) comprises at least one fastening element (24) for fastening the door handle (14) at the front panel (12). At least one conducting element (26) is attached at the inner side and/or outer side of the front panel (12). The fastening element (24) penetrates (Continued)

the front panel (12) and the conducting element (26), the conducting element (26) includes a terminal lug (32) connected or connectable to a grounding element (32), and the grounding element (30) is connected or connectable to a chassis of the domestic appliance, so that the door handle (14) is grounded via the fastening element (24), the conducting element (26), the terminal lug (32) and the grounding element (30).

18 Claims, 2 Drawing Sheets

(56) References Cited

U.S. PATENT DOCUMENTS 4,489,995 A 12/1984 Barr
4,543,800 A * 10/1985 Mawby ..... E05D 11/0081 439/165
5,263,509 A * 11/1993 Cherry ..... F25D 23/028 137/343
5,632,062 A * 5/1997 Katz ..... F24C 15/024 16/412
6,185,785 B1 * 2/2001 Kingston ..... E05B 1/0015 16/110.1
6,409,517 B2 * 6/2002 Malnati ..... H01R 13/6633 439/38
6,430,780 B1 * 8/2002 Kim ..... A47B 95/02 16/412
7,197,792 B2 * 4/2007 Moon ..... E05B 1/0015 16/412
7,357,467 B2 * 4/2008 Lee ..... A47B 95/02 16/422
7,703,451 B2 * 4/2010 Bang ..... F24C 15/022 126/190
7,752,713 B2 * 7/2010 Stura ..... E05D 11/0081 16/387
7,959,453 B2 * 6/2011 Guering ..... H02B 1/38 439/165
8,469,532 B2 * 6/2013 Pae ..... F25D 27/00 362/92
2002/0112320 A1 * 8/2002 Hayashi ..... E05D 11/0081 16/386
2003/0056334 A1 * 3/2003 Finkelstein ..... F24C 15/024 16/436
2005/0056046 A1 3/2005 Lee
2010/0287843 A1 * 11/2010 Oh ..... E05B 1/0015 49/460
2012/0127696 A1 * 5/2012 Glovatsky ..... F25D 27/00 362/92
2014/0304944 A1 * 10/2014 Carr ..... A47L 15/4257 16/110.1

FOREIGN PATENT DOCUMENTS

DE 102011087753 A1 * 6/2013 ..... F24C 15/024
EP 2868981 A1 5/2015
JP 2009293845 A 12/2009
WO 2013126946 A1 9/2013

* cited by examiner

DOMESTIC APPLIANCE AND DOOR FOR A DOMESTIC APPLIANCE

BACKGROUND OF THE INVENTION

The present invention relates to a door for a domestic appliance. Further, the present invention relates to a domestic appliance. In particular, the present invention relates to an oven door for a cooking oven and a corresponding cooking oven.

An electrostatic discharge is the transfer of charge between objects at different electrical potential. An electrostatic discharge accident may occur, if any charged conductor, e.g. also the human body, discharges to an electrostatic discharge sensitive device, or if said electrostatic discharge sensitive device discharges to packaging materials or to a human body. For example, people walking along a carpeted room or sitting in a car generate sufficient static electricity.

Further, the electrostatic discharge sensitive device may be placed in or at a door handle of a domestic appliance. If a human being walks along a carpeted room, then the human body may built up an electric potential of several thousand volts. Said electric potential may cause an electrostatic discharge, if the fingers are close to the door handle. When the human body feels a shock, the electrostatic discharge potential is about thousands of volts. The electronic components in a power module can be damaged by discharges of much lower voltage. In other words, the damage of the electronic components may occur even if the electrostatic discharge shock is not felt. The electrostatic discharge is one of the leading causes of failure in power modules and integrated circuits. Over the years, electronic devices have become faster and smaller, so that their electrostatic discharge sensitivity has been increased. Commonly, everyday objects used in or close to the working place, such a Styrofoam coffee cups, flooring materials, storage bins, desktops and even ordinary clothes are all sources of static electricity.

SUMMARY OF THE INVENTION

It is an object of the present invention to provide a door for a domestic appliance, wherein a door handle of said door is reliably grounded by low complexity.

The embodiments, features and combination of features as described herein in connection with the invention, as well as the combination of features as given in the annexed claims, but also any combination of features as mentioned and described in connection with the embodiments shall be considered as being disclosed herein, at least, however, shall be considered to be derivable by the skilled person.

In particular, each feature and each combination of features in the embodiments as described herein may for example be claimed in a different combination, in particular different claim category, at least because the skilled person will recognize that each and every combination of the features mentioned herein is suitable for contributing to solving the underlying problem.

According to the present invention a door according to the present invention, particularly for a domestic appliance according to the present invention, more particularly an oven door for a cooking oven, respectively, is provided.

Thereby it is to be understood that each embodiment, feature, technical effect or advantage, which is described herein in connection with the domestic appliance, particularly oven, of the present invention, may also be an embodiment, feature, technical effect or advantage, respectively, of the door according to the present invention, and vice versa.

A door according to the present invention, comprises

- a front panel,
  - at least one door handle made of metal and arranged at an outer side of the front panel,
  - at least one electric and/or electronic device arranged inside and/or at the door handle,
  - at least one fastening element for fastening the door handle at the front panel.

Moreover, at least one conducting element is attached at the inner side and/or outer side of the front panel,

- the fastening element penetrates the front panel and the conducting element,
- the conducting element includes a terminal lug connected or connectable to a grounding element, and
- the grounding element is connected or connectable to a chassis of the domestic appliance,
- so that the door handle is grounded via the fastening element, the conducting element, the terminal lug and the grounding element.

The core of the present invention is that the door handle is grounded via the fastening element, the conducting element, the terminal lug and the grounding element. Particularly, each of said fastening element, the conducting element, the terminal lug and the grounding element is made of a conducting material, preferably a conducting metal or metal alloy. Thus, it is not necessary to connect the grounding element directly to the door handle. No further grounding components are required, since the fastening element causes the grounding of the door handle. Further, the door handle may be disassembled from the front panel, e.g. for cleaning purposes, without disconnecting the grounding element. The grounding of the door handle is realized by low complexity and low costs. The grounding concept of the present invention is very robust. Moreover, the grounding concept is independent from the power supply concept of the oven door and from the design of the door handle. At last, the grounding concept is independent from the structure and the properties of the electronic device.

Within the present application, terms such as "lateral" or "laterally", "rear", "frontal", "upper", "lower", "bottom", "opposite", "inner", "outer" or the like, as used herein, which describe the position of a first object relative to another object, preferably refer to the relative position of a respective part or object with regard to its position fully mounted for its intended use.

The grounding element preferably is a grounding wire or grounding stripe, more preferably a grounding wire.

Preferably, the door comprises a door frame or a pair of door columns, wherein the door frame or door columns, respectively, are attached at an inner side of the front panel.

In this case, the fastening element may penetrate into the door frame or door column, respectively, so that the fastening element and the door handle are supported by the door frame or door column, respectively. The fastening element, preferably is an elongate element, particularly a screw or pin, most preferably a screw. Particularly, the fastening element is preferably made from an electrically conducting material, more preferably electrically conducting metal or conducting metal alloy.

In particular, the conducting element may include a receiving, particularly a hole for receiving the fastening element. Particularly, the conducting element may comprise a hole with an internal thread, wherein an external thread of the fastening element engages the internal thread of the conducting element. This guarantees an electric conductivity between the conducting element and the fastening element.

For example, the conducting element is glued at the inner side and/or outer side of the front panel, wherein the fastening element and the door handle are supported by the conducting element.

Further, the door handle may be an elongated hollow cylinder made of metal, in particular made of aluminium.

Preferably, the door comprises at least one adapter arranged between the door handle and the outer side of the front panel, wherein preferably the fastening element penetrates said adapter. The adapter acts as a spacer between the door handle and the outer side of the front panel.

Furthermore, the door comprises power supply wires interconnected between the electric and/or electronic device and the chassis of the domestic appliance, wherein a portion of said power supply wires extends inside the door handle.

For example, a further portion of the power supply wires extends inside or at the door frame or door column.

Preferably, at least a portion of the power supply wires and at least a portion of the grounding element form a multicore cable. This contributes to a compact structure of the door.

In particular, the grounding element is arranged inside or at the door frame or door column, respectively, of the door.

For example, the grounding element is directly connected or connectable to the chassis of the domestic appliance.

According to another example, the grounding element is connected or connectable to the chassis of the domestic appliance via a pogo spring connection.

Furthermore, the grounding element may be connected or connectable to the chassis of the domestic appliance via sliding contact stripes.

Novel and inventive features of the present invention are set forth in the appended claims.

BRIEF DESCRIPTION OF THE DRAWINGS

The present invention will be described in further detail with reference to the drawings from which further features, embodiments and advantages may be taken, and in which.

DESCRIPTION OF THE PREFERRED EMBODIMENT

In the embodiments shown in the figures, elements similar or identic in function are designated with like reference signs. It is noted, that the figures may not be true to scale with respect to each other.

Figure 1:
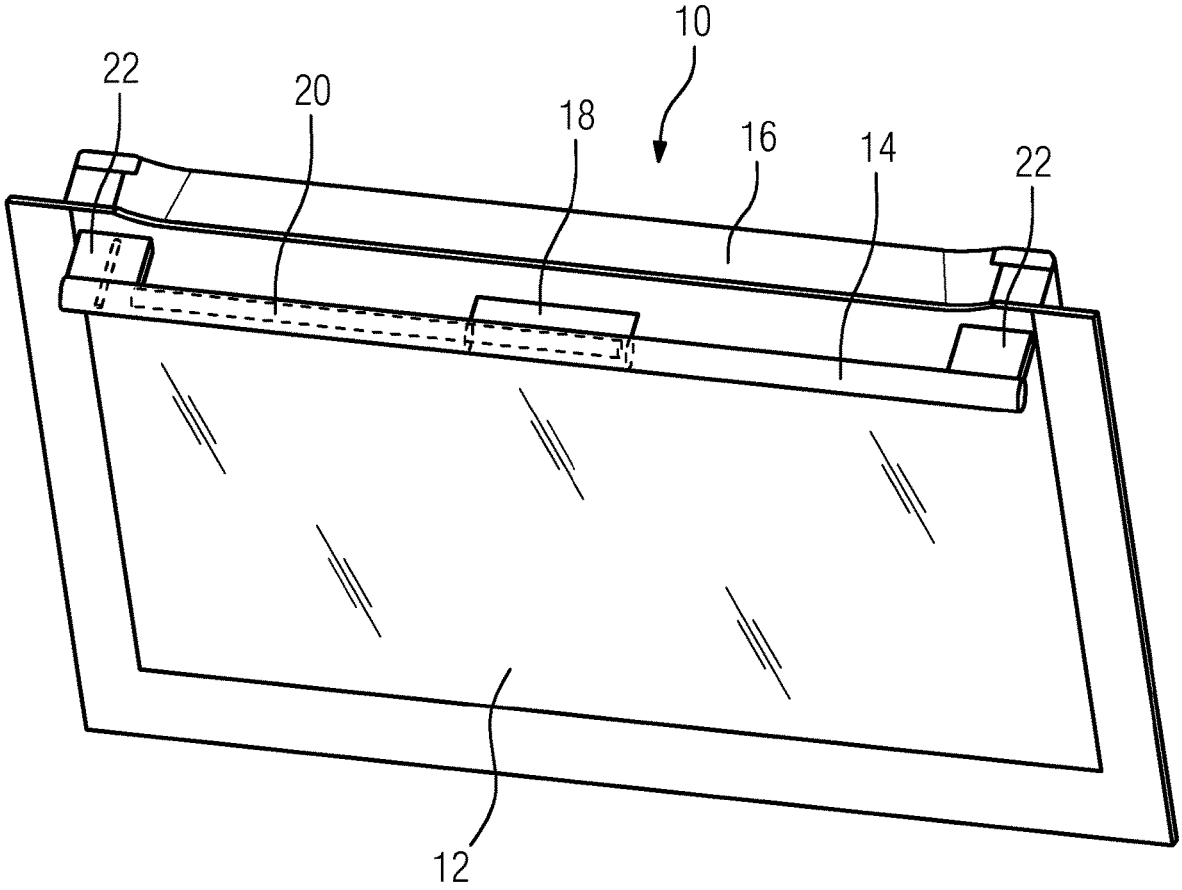
FIG. 1 illustrates a schematic perspective view of an oven door including a protection device against electrostatic discharge according to a preferred embodiment of the present invention.

FIG. 1 illustrates a schematic perspective view of an oven door 10 including a protection device against electrostatic discharge according to a preferred embodiment of the present invention. In general, the present invention relates to a door for an arbitrary domestic appliance, wherein said door includes the protection device.

The oven door 10 comprises a front panel 12, a door handle 14 and a door frame 16. The door handle 14 is attached at an outer side of the front panel 12. The door frame 16 is attached at an inner side of the front panel 12. The door handle 14 is formed as an elongated hollow cylinder and extends horizontally. The door handle 14 is made of metal, preferably of aluminium. The door handle 14 is attached via two adapters 22 at the outer side of the front panel 12. Said adapters 22 act as spacers between the door handle 14 and the outer side of the front panel 12.

An electronic device 18 is arranged at least partially within the door handle 14. In this example, a part of the electronic device 18 is arranged inside the door handle 14, while another part of the electronic device 18 is arranged out of the door handle 14 and between the front panel 12 and said door handle 14. The electronic device 18 is electrically insulated from the door handle 14. Power supply wires 20 are connected to the electronic device 18. The power supply wires 20 extend inside the door handle 14. The power supply wires 20 penetrate the adapter 22 and the front panel 12.

Optionally, further wires, e.g. signal wires, may be connected to the electronic device 18, wherein said further wires extend inside the door handle 14 and penetrate the adapter 22 and the front panel 12.

Figure 2:
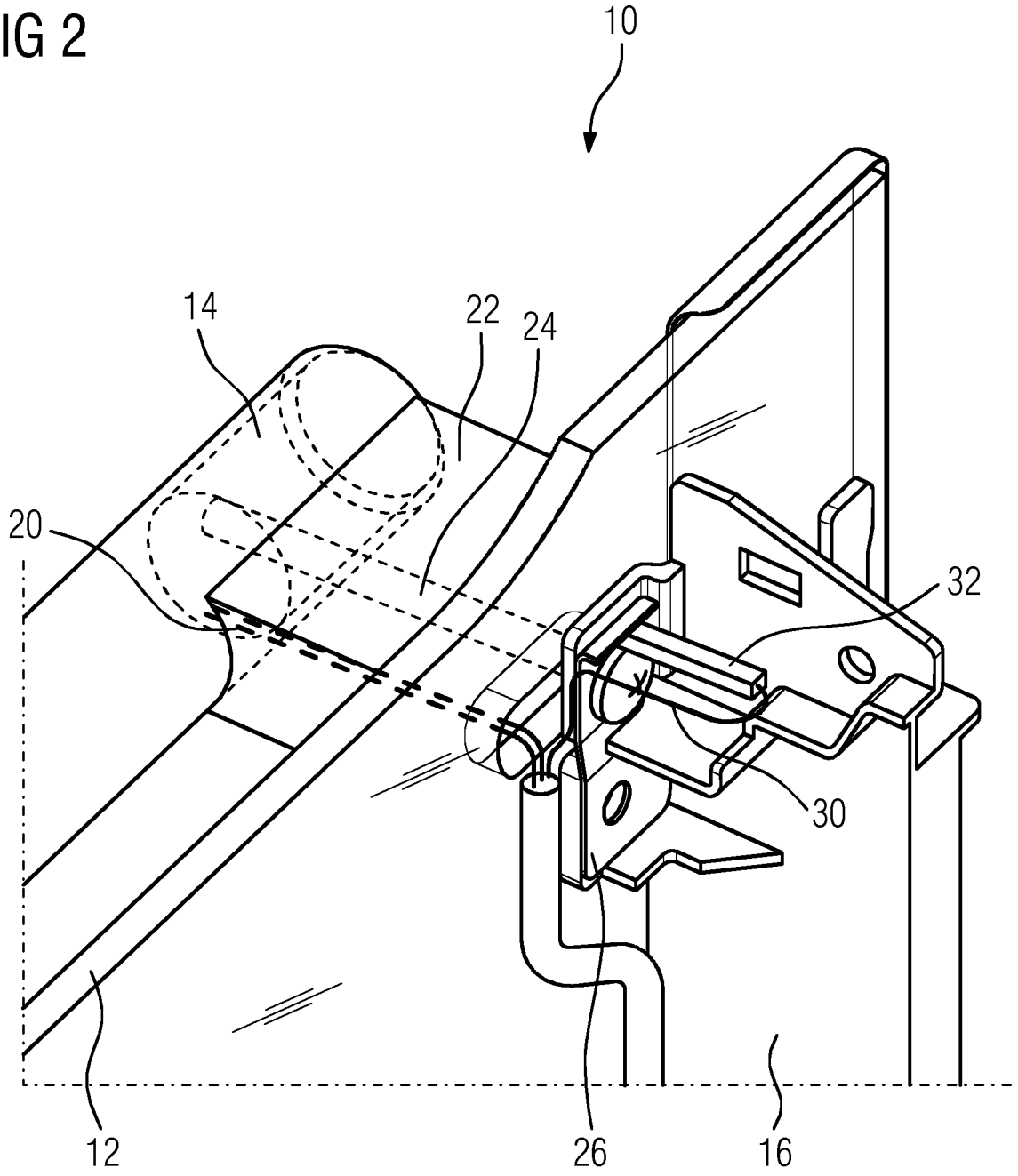
FIG. 2 illustrates a detailed schematic perspective view of the oven door including the protection device against electrostatic discharge according to the preferred embodiment of the present invention.

FIG. 2 illustrates a detailed schematic perspective view of the oven door 10 including the protection device against electrostatic discharge according to the preferred embodiment of the present invention. FIG. 2 shows an upper corner of the oven door 10. In FIG. 2 only a vertical profile part of the door frame 16 is shown.

The door handle 14 and the adapter 22 are attached at the outer side of the front panel 12 by a fastening element 24, here a screw 24. Said screw 24 is made of metal and penetrates the door handle 14, the adapter 22, the front panel 12 and optionally the vertical profile part of the door frame 16. The screw 24 is connected to a conducting element 26, here a metal element 26, aligned at the inner side of the front panel 12. In this example, the metal element 26 is a washer. For example, the metal element 26 is glued at the inner side of the front panel 12. Preferably, the metal element 26 includes a hole with an internal thread, so that an external thread of the screw 24 engages the internal thread of the metal element 26. Thus, the screw 24 and the metal element 26 are galvanically connected to each other. Further, the metal element 26 includes a terminal lug 32. A grounding element 30, here a grounding wire 30, is connected to the terminal lug 32 via a plug-in connection. Another end of said grounding wire 30 is connected to a chassis of a cooking oven. Thus, the door handle 14 is grounded via the screw 24, the metal element 26, the terminal lug 32 and the grounding wire 30. This grounding concept of the door handle 14 avoids electrostatic discharges.

The door handle 14 and the screw 24 are supported by the metal element 26 or by the door frame 16, in particular by the vertical profile part of the door frame 16. Further, the door handle 14 and the screw 24 may be supported by both the metal element 26 and the door frame 16. If the door handle 14 and the screw 24 are supported by the door frame 16, then the metal element 26 may be also supported by the screw 24 and the door frame 16. In general, the metal element 26 is attached at the inner side or outer side of the front panel 12.

In this example, the power supply wires 20 as well as the grounding wire 30 are arranged inside or at the vertical profile part of the door frame 16. The grounding wire 30 may be directly connected to the chassis of the cooking oven. Further, grounding wire 30 may be connected to the chassis of the cooking oven via a grounding pogo spring element, if the power supply is realized by a pogo spring connection. Moreover, the grounding wire 30 may be connected to the chassis of the cooking oven via sliding contact stripes. Said sliding contact stripes are often used for the power transfer between the chassis and the oven door 10.

The present invention has the advantage that the grounding wire 30 does not have to be pushed through the hollow door handle 14. Further, it is not necessary to connect the grounding wire 30 directly to the door handle 14. No further grounding components are required, since the screw 24 supports the grounding of the door handle 14. The door handle 14 may be disassembled from the front panel 12, e.g. for cleaning purposes, without disconnecting the grounding wire 30. The grounding of the door handle 14 is realized by low complexity and low costs. The grounding concept according to the present invention is very robust. Moreover, the grounding concept is independent from the power supply concept of the oven door 10. The grounding concept is independent from the design of the door handle 14. Additionally, the grounding concept is independent from the structure and the properties of the electronic device 18.

The electric insulation between the electronic device 18 and the door handle 14 on the one hand and the grounding concept of the present invention protects the electronic device 18 from damages by electrostatic discharge.

The embodiments in the figures may relate to preferred embodiments, while all elements and features described in connection with embodiments may be used, as far as appropriate, in combination with any other embodiment and feature as discussed herein, in particular related to any other embodiment discussed further above.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 oven door
12 front panel
14 door handle
16 door frame
18 electric device
20 power supply wires
22 adapter
24 screw
26 metal element
30 grounding wire
32 terminal lug

The invention claimed is:

1. A domestic appliance comprising a door for the domestic appliance, wherein the door comprises:

a front panel, at least one door handle made of metal and arranged at an outer side of the front panel, at least one electric and/or electronic device arranged inside and/or at the door handle, at least one fastening element for fastening the door handle at the front panel, and at least one conducting element attached at the inner side and/or outer side of the front panel, the fastening element penetrating the front panel and the conducting element, the conducting element comprising a terminal lug connected or connectable to a grounding element, the grounding element being connected or connectable to a chassis of the domestic appliance, so that the door handle is grounded via the fastening element, the conducting element, the terminal lug and the grounding element.

2. The domestic appliance according to claim 1, the door further comprising a door frame or a pair of door columns, wherein the door frame or door columns, respectively, is/are attached at an inner side of the front panel.

3. The domestic appliance according to claim 2, wherein the fastening element penetrates into the door frame or door column, respectively, so that the fastening element and the door handle are supported by the door frame or door column, respectively.

4. The domestic appliance according to claim 1, the conducting element comprising a hole with an internal thread, wherein an external thread of the fastening element engages the internal thread of the conducting element.

5. The domestic appliance according to claim 1, wherein the conducting element is glued at the inner side and/or outer side of the front panel, wherein the fastening element and the door handle are supported by the conducting element.

6. The domestic appliance according to claim 1, wherein the door handle is an elongated hollow cylinder made of metal.

7. The domestic appliance according to claim 1, the door further comprising at least one adapter arranged between the door handle and the outer side of the front panel.

8. The domestic appliance according to claim 1, the door further comprising power supply wires interconnected between the electric and/or electronic device and the chassis of the domestic appliance, wherein a portion of said power supply wires extends inside the door handle.

9. The domestic appliance according to claim 8, wherein a further portion of the power supply wires extends inside or at the door frame or door column.

10. The domestic appliance according to claim 8, wherein at least a portion of the power supply wires and at least a portion of the grounding element form a multicore cable.

11. The domestic appliance according to claim 1, wherein the grounding element is arranged inside or at the door frame or door column, respectively, of the door.

12. The domestic appliance according to claim 1, wherein the grounding element is directly connected or connectable to the chassis of the domestic appliance.

13. The domestic appliance according to claim 1, wherein the grounding element is connected or connectable to the chassis of the domestic appliance via a pogo spring connection.

14. The domestic appliance according to claim 1, wherein the grounding element is connected or connectable to the chassis of the domestic appliance via sliding contact stripes.

15. The domestic appliance according to claim 7, wherein said fastening element penetrates said adapter.

16. A domestic appliance comprising an appliance door, the door comprising a front panel and an electrically conductive door handle, the door handle comprising an electronic component disposed therein and electrically insulated from the door handle, the door handle being reversibly attached at an outer side of the front panel via an elongated, electrically-conductive fastening element that penetrates said front panel and is reversibly, galvanically connected to and supported by a metal conducting element attached at an inner side of the front panel, a grounding wire providing electrical communication between said metal conducting element and a chassis of said domestic appliance such that said door handle is grounded to said chassis via said fastening element, said conducting element and said grounding wire, all of which together defining an electrical grounding path therebetween, said fastening element thereby reversibly securing said door handle to said door and establishing said grounding path between said door and said chassis, wherein said grounding wire is not directly connected to said door handle such that removal of said door handle from said door does not require disconnection of said grounding wire therefrom, said grounding path being independent of a power supply for supplying power to said electronic component within said door handle.

17. The domestic appliance according to claim 16, said door further comprising an adaptor disposed intermediate said front panel and said handle to space said handle a predetermined distance from said outer side of said front panel, said fastening element penetrating said adaptor, said fastening element being a screw that is received by and attached to said conducting element via a threaded connection.

18. The domestic appliance according to claim 16, said grounding wire being directly connected to said chassis of said appliance.

* * * * *